US006719397B1

(12) United States Patent
Hu et al.

(10) Patent No.: US 6,719,397 B1
(45) Date of Patent: Apr. 13, 2004

(54) INK JET PRINTHEAD IDENTIFICATION CIRCUIT AND METHOD

(75) Inventors: Hung-Lieh Hu, Hsinchu (TW); Chi-Lung Li, Hsinchu (TW); Jack Wu, Hsinchu (TW); Chieh-Wen Wang, Hsinchu (TW)

(73) Assignee: International United Technology Co., Ltd., Hsinchu (TW)

( * ) Notice: Subject to any disclaimer, the term of this patent is extended or adjusted under 35 U.S.C. 154(b) by 0 days.

(21) Appl. No.: 10/359,578

(22) Filed: Feb. 7, 2003

(51) Int. Cl.[7] ..... B41J 29/393
(52) U.S. Cl. ..... 347/19; 347/7
(58) Field of Search ..... 347/5, 19, 86, 347/87, 7

(56) References Cited

U.S. PATENT DOCUMENTS 5,363,134 A * 11/1994 Barbehenn et al. ..... 347/49
5,504,507 A * 4/1996 Watrobski et al. ..... 347/19
5,757,394 A * 5/1998 Gibson et al. ..... 347/19
5,940,095 A * 8/1999 Parish et al. ..... 347/19
5,966,144 A * 10/1999 Edwards ..... 347/7
6,022,094 A * 2/2000 Gibson et al. ..... 347/19
6,568,783 B2 * 5/2003 Hu et al. ..... 347/19

* cited by examiner

*Primary Examiner*—Thinh Nguyen
*Assistant Examiner*—Julian D. Huffman
(74) *Attorney, Agent, or Firm*—Troxell Law Office PLLC

(57) ABSTRACT

The present invention provides an ink jet printhead identification circuit and method. The identification circuit is constructed of a fuse and other electronic components. A plurality of circuits are arranged and integrated on the printhead of the cartridge and encoded prior to leaving the factory subjecting the identification and detection circuits to achieve its identification purpose (of identifying general information of the cartridge, such as model number, serial number, color or gray-scale setting, and best printing quality). The circuits may alternatively be encoded subsequent to leaving the factory and usage to a certain state subjecting the identification circuits to achieve its detection purpose (of detecting the current status of the cartridge, such as whether its lifespan has elapsed).

7 Claims, 7 Drawing Sheets

INK JET PRINTHEAD IDENTIFICATION CIRCUIT AND METHOD

FIELD OF INVENTION

The present invention provides an identification circuit, in particular one for an inkjet printhead using shift registers to transmit the inkjet printhead identification codes to a controller in order.

BACKGROUND OF INVENTION

Consumer demand for product performance increases with technology advancement. Taking inkjet printers as an example, a variety of inkjet printers meeting various printing demands have been developed while each inkjet printer may correspond to a variety of cartridges, such as black ink cartridge, color ink cartridge, and cartridges capable of providing different numbers of jetting orifices on the printhead. The inkjet printer is capable of controlling individual cartridges through different control programs in light of the model or serial number assigned to each cartridge. Due to the various types of available cartridges, in order to prevent users from mistakenly installing an improper cartridge to an inkjet printer and rendering abnormal operation of the inkjet printer, when a cartridge is installed to an inkjet printer, the inkjet printer will identify the cartridge to ensure that the cartridge is applicable to such inkjet printer. An identification circuit is included in each printhead of the cartridge to allow the inkjet printer to identify the cartridge. The identification circuit of the cartridge is only used when the cartridge is first installed to the inkjet printer and is no longer needed once the cartridge has been identified.

FIGS. 1 and 2 illustrate a conventional inkjet printer 10 and a conventional cartridge 12, respectively. As shown in FIG. 1, the inkjet printer 10 includes at least one cartridge 12 installed to the inkjet printer 10. As shown in FIG. 2, the cartridge 12 includes a printhead 14 and a housing 16. The printhead 14 includes a chip 18 and a flexible print circuit board 13. The chip 18 is formed there on with a plurality of orifices 15. The housing 16 includes therein an ink reservoir 17 for storing ink. The printhead 14 and ink reservoir 17 communicate to one another. The ink in the ink reservoir 17 is sprayed from the orifices 15 through the printhead 14 upon heating so as to perform the prescribed printing operation.

FIGS. 3 and 4 disclose the identification circuit diagrams of a one-bit shift register 20 and a parallel in, serial out four-bit shift register 2, respectively, as disclosed in U.S. Pat. No. 5,940,095 entitled "Ink Jet Print Head Identification Circuit with Serial Out, Dynamic Shift Registers" and assigned to Lexmark International Incorporation.

By referring to FIG. 3, in U.S. Pat. No. 5,940,095, a default logic binary code (0 or 1) is digitally encoded into the one-bit shift register 20 as being mask programmed during fabrication by:

(1) Connecting the source 24 of load transistor 22 to ground 21 and disconnecting the source 24 to voltage source 23, or (2) Connecting the source 24 of load transistor 22 to a voltage source 23 and disconnecting the source 24 to ground 21.

Under condition (1), a default logic "0" encoded to the one-bit shift register 20 is read at the output line 28 when load 25, clock one 26, and clock two 27 are activated in sequence. On the other hand, under condition (2), a default lock "1" encoded to the one-bit shift register 20 is read at the output line 28.

FIG. 4 is the identification circuit diagram of a parallel in, serial out, four-bit shift register 2 as illustrated in U.S. Pat. No. 5,940,095. The circuit includes four serially connected one-bit shift registers 20*a*, 20*b*, 20*c*, 20*d* as shown in FIG. 3. The input lines of the one-bit shift registers 20*b*, 20*c*, 20*d* (the input line 29 in FIG. 3) are electrically connected to the output lines of the one-bit shift register 20*a*, 20*b*, 20*c* (the output line 28 in FIG. 3), respectively. When load 25, clock one 26, and clock two 27 are activated in order, the default binary codes encoded to the one-bit shift registers 20*d*, 20*c*, 20*b*, 20*a* are read from the output line 28 in sequence. If the identification code of a certain model number of an inkjet printhead is 0101, and the default binary codes being sequentially read from the one-bit shift registers 20*d*, 20*c*, 20*b*, 20*a* are 0, 1, 0 and 1, the printer (or computer) identifies the model number of the inkjet printhead. Similarly, if the identification code of a color inkjet printhead is 0001 and the default binary codes being sequentially read from the one-bit shift registers 20*d*, 20*c*, 20*b*, 20*a* are 0, 0, 0 and 1, the printer (or computer) identifies the inkjet printhead is for color printing.

In U.S. Pat. No. 5,940,095, however, the one-bit shift registers 20*a*, 20*b*, 20*c*, 20*d* are each mask programmed during fabrication to produce a default binary code (0 or 1) for allowing the printer (or computer) to identify the general information related to cartridges, while failing to record the current status of the inkjet printhead that being in use after leaving the factory.

Hence, the present invention provides an identification circuit for an inkjet printer cartridge capable of recording the current status of the inkjet printhead being in use after leaving the factory.

SUMMARY OF THE INVENTION

It is, thus, an object of the present invention to provide an ink jet printhead identification circuit and method constructed of fuses and other electronic components.

It is a further object of the present invention to provide an ink jet printhead identification circuit and method being encoded prior to leaving the factory for achieving its identification purpose (of identifying such general information of the cartridge as model number, serial number, color or gray-scale setting, and printing quality, etc.).

It is yet another object of the present invention to provide an ink jet printhead identification circuit and method that is encoded subsequent to leaving the factory for achieving its identification purpose (of detecting the current status of the cartridge).

DETAILED DESCRIPTION OF PREFERRED EMBODIMENTS

Most printers currently available on market use ink in cyan, magenta, and yellow. The consumption for respective color ink is calculated by the control circuit of the printer during printing, and recorded to assess the respective accumulative consumption of each color ink as well as the total accumulative consumption of all color ink up-to-date, since near exhaustion of any of the three color ink will render an unreliable printing quality.

Figure 5:
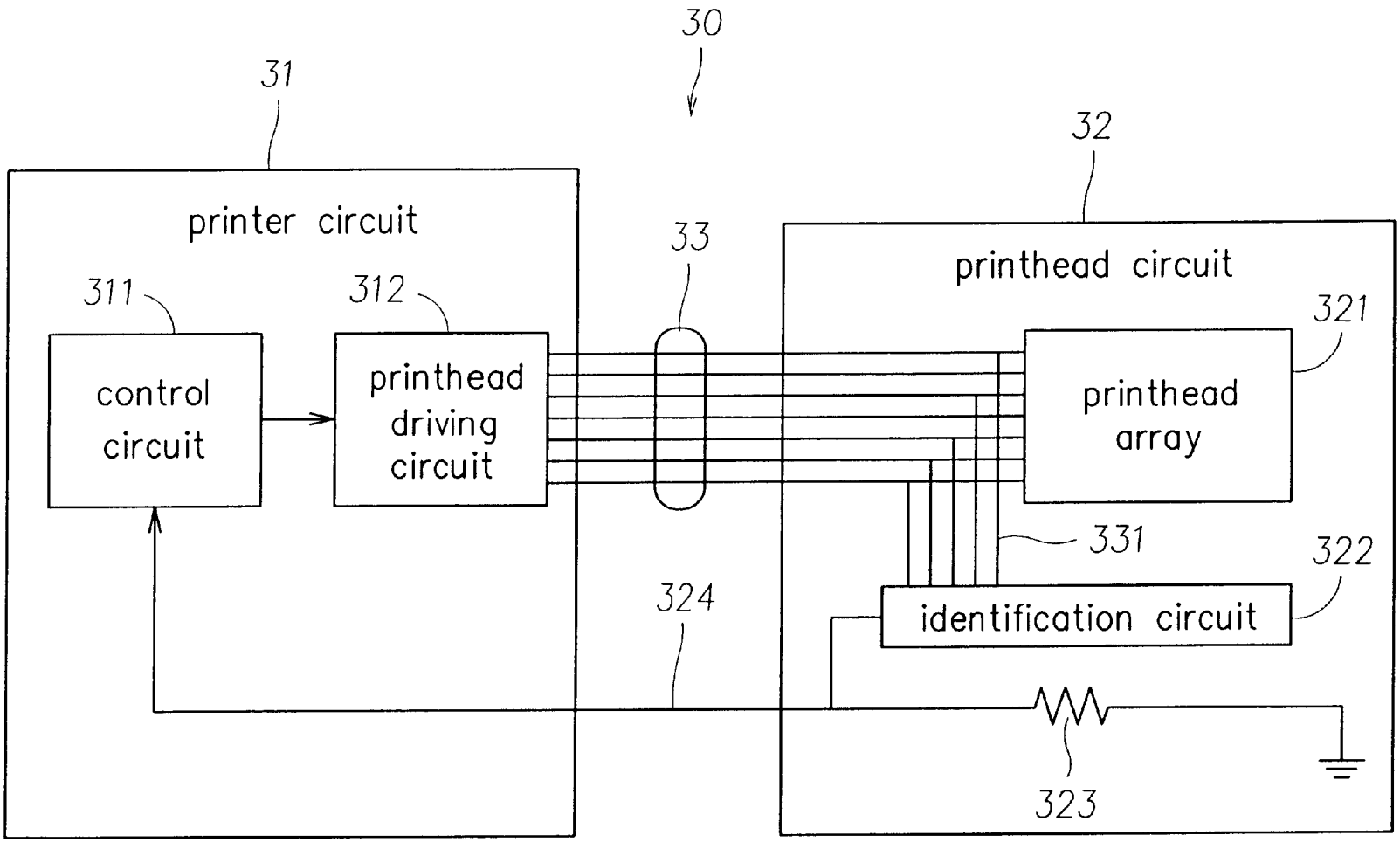
FIG. 5 is a block diagram showing the inkjet printhead identification system in accordance with the present invention.

FIG. 5 illustrates a block diagram of the inkjet printhead identification and detection system 30 in accordance with the present invention. The system includes a printer circuit 31 and a printhead circuit 32. The printer circuit 31 includes a control circuit 311 and a printhead driving circuit 312 electrically connected to the control circuit 311. The printhead circuit 32 includes a printhead array 321, an identification circuit 322, and a resistor 323. The printhead driving circuit 312 is connected to the printhead array 321 via a plurality of address lines 33. At last part of the address lines 331 in the plurality of address lines 33 are in parallel connection with the identification circuit 322. The identification circuit 322 and resistor 323 are electrically connected to an output line 324 of the identification circuit 322. The other end of the resistor 323 is grounded.

When the ink in the cartridge is near exhaustion and the counter (not shown) in the circuit 311 has accumulated to a preset value, the control circuit 311 will transmit a modified identification code to the identification circuit 322, and selects the address lines corresponding to the burned fuses. The encoding procedure for burning is then activated based on condition (1) or (2) described in the following embodiments for generating a four-bit binary code (such as 1011). The four-bit binary code is then recorded on a chip (See chip 14 of FIG. 2) of the inkjet printhead, such that the printer is capable of detection at the output line 324 if the lifespan of the inkjet printhead has elapsed so as to ensure printing quality. Further, when any of the three color ink is near exhaustion, a signal may be generated based on the default setting to produce a four-bit binary code (such as 1011) to be recorded on the chip of the inkjet printhead, such that the printer is capable of detecting the lifespan of the cartridge has elapsed and thus prohibit the cartridge from further use.

The transistors described in the following embodiments are field effect transistor (FET), hereafter referred to as "transistor" in short.

First Preferred Embodiment

Figure 6:
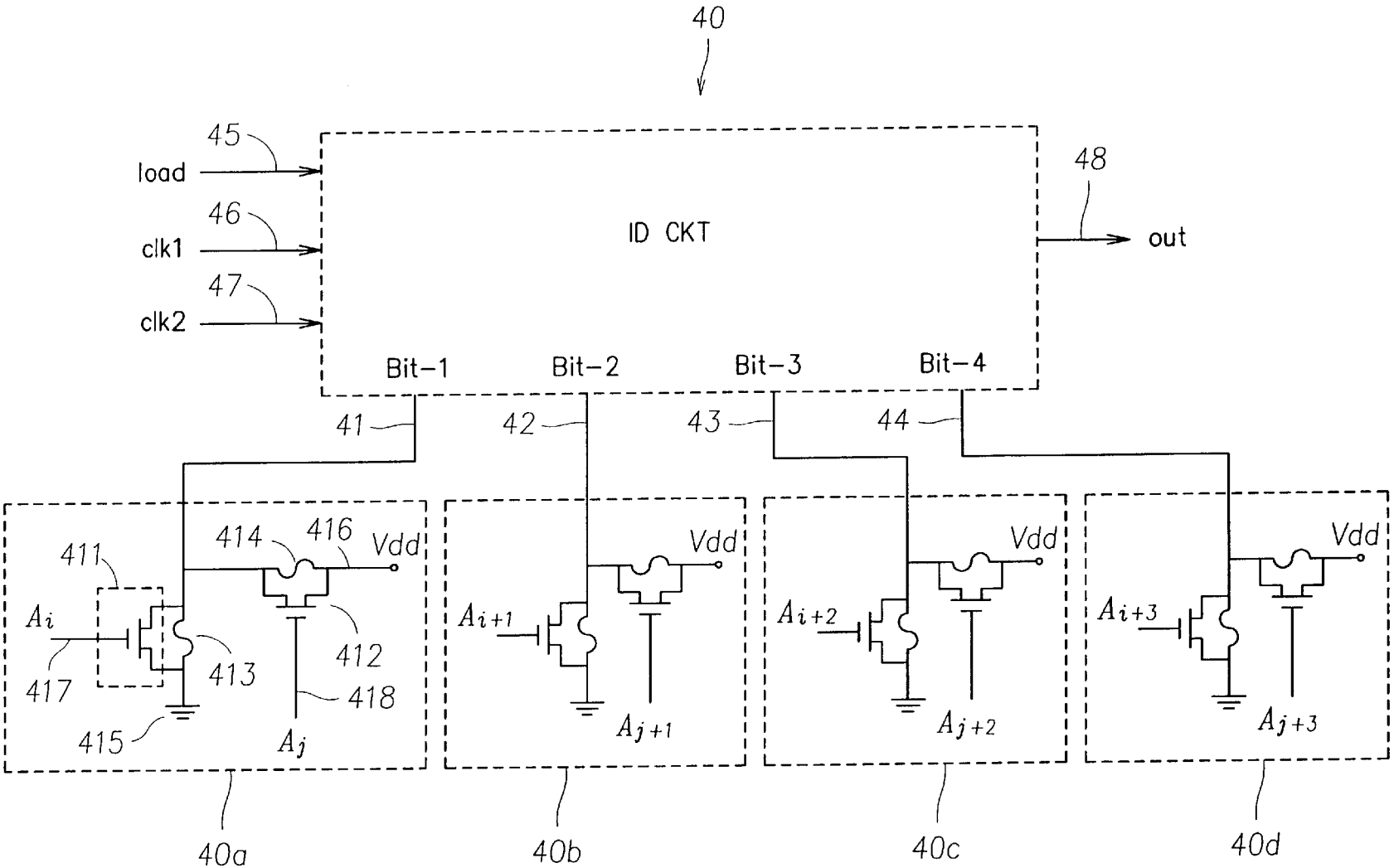
FIG. 6 is an identification circuit diagram of a parallel in, serial out, four-bit shift register in accordance with a first preferred embodiment of the present invention.

FIG. 6 illustrates an identification circuit diagram of a parallel in, serial out, four-bit shift register 40 in accordance with a first preferred embodiment of the present invention. The four-bit shift register 40 mainly comprises a first, a second, a third and a fourth one-bit shift register fuse circuits 40*a*, 40*b*, 40*c*, 40*d* in serial connection.

Taking the first one-bit shift register fuse circuit 40*a* as an example, each programming route is formed of serial connection of a first circuit set and a second circuit set, wherein the first and second circuit sets each includes parallel connection of a fuse and a corresponding transistor. Each programming route furnishes a one-bit identification code. The first circuit set of parallel connection of a first transistor 411 and a first fuse 413, is in serial connection with the second circuit set of parallel connection of a second transistor 412 and a second fuse 414. The electrical connection between the two circuit sets is an output line 41 of the one-bit identification code. The ends of the first and second circuit sets are electrically connected to a ground 415 and a power source 416, respectively. The gates of the first transistor 411 and the second transistor 412 are electrically connected to a first address line ($A_i$) 417 and a second address line ($A_j$) 418, respectively. The program encoded to the first one-bit shift register fuse circuit 40*a* can only be one of the following two conditions:

Condition (1): When an appropriate voltage $V_{dd}$ is applied to the power source 416 and while the first address line 417 turns on the first transistor 411 and the second address line 418 turns off the second transistor 412, a programming route starts at the power source 416, going through the second fuse 414 and the first transistor 411, and ends at the ground 415. The voltage $V_{dd}$ is sufficient to burn the second fuse 414. As such, a low level signal equivalent to 0 may be detected at the output line 41, as described hereinafter, for completing the encoding of the first one-bit shift register fuse circuit 40*a* and furnishing a one-bit identification code of '0'.

Condition (2): When an appropriate voltage $V_{dd}$ is applied to the power source 416 and while the second address line 418 turns on the second transistor 412 and the first address line 417 turns off the first transistor 411, a programming route starts at the power source 416, going through the second transistor 412 and the first fuse 413, and ends at the ground 415. The appropriate voltage $V_{dd}$ is sufficient to burn the first fuse 413. As such, a high level signal equivalent to 1 may be detected from the output line 41, as described hereinafter, for completing the encoding of the first one-bit shift register fuse circuit 40*a* and furnishing a one-bit identification code of '1'.

The same principle may be applied to the second, third and fourth one-bit shift register fuse circuits 40*b*, 40*c*, 40*d* based on condition (1) or (2) to complete the encoding of the second, third and fourth one-bit shift register fuse circuits 40*b*, 40*c*, 40*d* and to furnish a one-bit identification code of '0' or '1', respectively.

After completion of the encoding process, the first, second, third and fourth one-bit shift register fuse circuits 40*a*, 40*b*, 40*c*, 40*d* as shown in FIG. 6 are each capable of furnishing a one-bit identification code of 0 or 1. When load 45, clock one 46 and clock two 47 are activated in order, the four-bit shift register 40 in accordance with the first embodiment of the present invention outputs the furnished binary codes of the one-bit shift register fuse circuits 40*d*, 40*c*, 40*b* and 40*a* in sequence, at the output line 48. As such, the printer is capable of identifying the model number, color/gray-scale setting, and resolution of cartridge, and to detect whether the lifespan of the cartridge has elapsed based on the corresponding properties of the binary codes. By encoding binary codes prior to leaving the factory, the present invention provides identification of cartridge (model number, color/gray-scale setting, and resolution, etc.). By encoding binary codes after leaving the factory, the present invention provides detection of the current status of the cartridge (whether the lifespan of the cartridge has elapsed, etc.).

Second Preferred Embodiment

Figure 7:
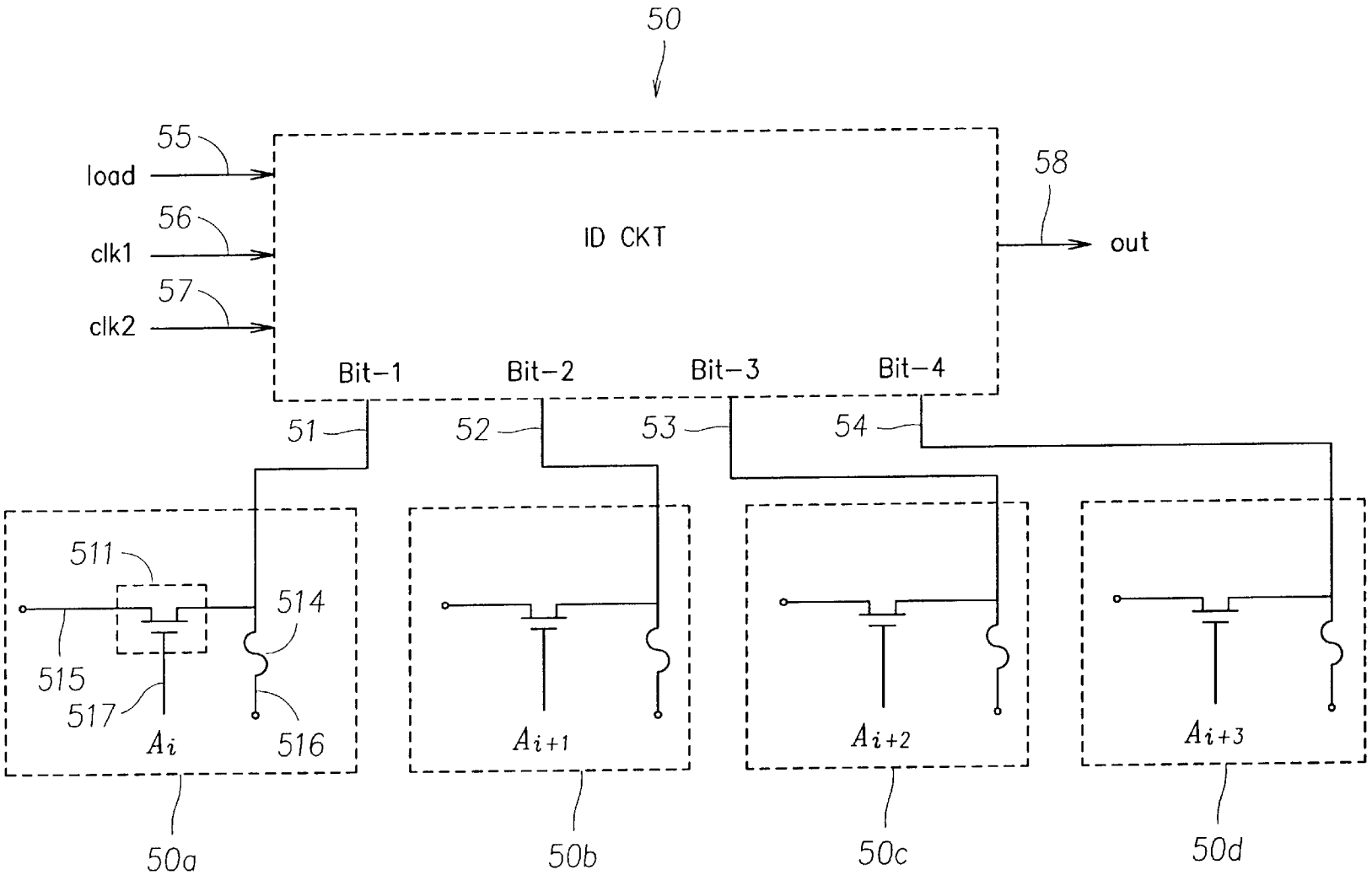
FIG. 7 is an identification circuit diagram of a parallel in, serial out, four-bit shift register in accordance with a second preferred embodiment of the present invention.

FIG. 7 illustrates an identification circuit diagram of a parallel in, serial out, four-bit shift register 50 in accordance with a second preferred embodiment of the present invention. The four-bit shift register 50 mainly comprises a first, a second, a third and a fourth one-bit shift register fuse circuits 50*a*, 50*b*, 50*c*, 50*d* in serial connection.

Taking the first one-bit shift register fuse circuit 50*a* as an example, each programming route furnishes a one-bit identification code. A transistor 511 is in serial connection with a fuse 514. The connection between the two is an output line 51 of the one-bit identification code. The other ends of the transistor 511 and fuse 514 are electrically connected to a first power source 515 and a second power source 516, respectively. The gate of the transistor 511 is electrically connected to an address line ($A_i$) 517.

The first power source 515 has the option of being connected either to a voltage source for accessing voltage or to an address line.

The program encoded to the first one-bit shift register fuse circuit 50*a* can only be one of the following two conditions:

Condition (1): When a high voltage $V_1$ is applied to the first power source 515 and the second power source 516 is grounded and while the address line 517 turns on the transistor 511, a programming route starts at the power source 515, going through the transistor 511 and the fuse 514, and ends at the second power source (ground) 516. The high voltage $V_1$ is sufficient to burn the fuse 514. As such, a low level signal equivalent to 0 may be detected at the output line 51, as described hereinafter, for completing the encoding of the first one-bit shift register fuse circuit 50*a* and furnishing a one-bit identification code of '0'. When a logic high voltage is applied to the second power source 516 and a low voltage is applied to the address line 517 to turn off the transistor 511, the burned fuse 514 would prevent the logic high voltage at the second power source 516 from being read at the output line 51. Instead, a low level signal equivalent to 0 is the first bit read by the first one-bit shift register fuse circuit 50*a*.

Condition (2): By turning off the transistor 511 via the address line 517 that is connected to a low voltage such that the voltage $V_I$ applied to the first power source 515 cannot reach the fuse 514, the integrity and conductivity of the fuse 514 is preserved. As such, a high level signal equivalent to 1 may be detected at the output line 51, as described hereinafter, for completing the encoding of the first one-bit shift register fuse circuit 50*a* and furnishing a one-bit identification code of '1'. As a logic high voltage is applied to the second power source 516 and a low voltage is applied to the address line 517 to turn off the transistor 511, the logic high voltage at the second power source 516 will then pass through the fuse 514 and transmitted to the first bit of the four-bit shift register 50 via the output line 51, such that the first bit of the four-bit shift register 50 is a high level signal equivalent to 1.

The same principle may be applied to the second, third and fourth one-bit shift register fuse circuits 50*b*, 50*c*, 50*d* based on condition (1) or (2) to complete the encoding of the second, third and fourth one-bit shift register fuse circuits 50*b*, 50*c*, 50*d* and to furnish a one-bit identification code of '0' or '1', respectively.

After completion of the encoding process, the first, second, third and fourth one-bit shift register fuse circuits 50*a*, 50*b*, 50*c*, 50*d* as shown in FIG. 7 are each capable of furnishing a one-bit identification code of 0 or 1. When load 55, clock one 56 and clock two 57 are activated in order, the four-bit shift register 50 in accordance with the second embodiment of the present invention outputs the furnished binary codes of the one-bit shift register fuse circuits 50*d*, 50*c*, 50*b* and 50*a* in sequence, at the output line 58. As such, the printer is capable of identifying the model number, color/gray-scale setting, and resolution of cartridge, and to detect whether the lifespan of the cartridge has elapsed based on the corresponding properties of the binary codes. By encoding binary codes prior to leaving the factory, the present invention provides identification of cartridge (model number, color/gray-scale setting, and resolution, etc.). By encoding binary codes after leaving the factory, the present invention provides detection of the current status of the cartridge (whether the lifespan of the cartridge has elapsed, etc.).

Third Preferred Embodiment

Figure 8:
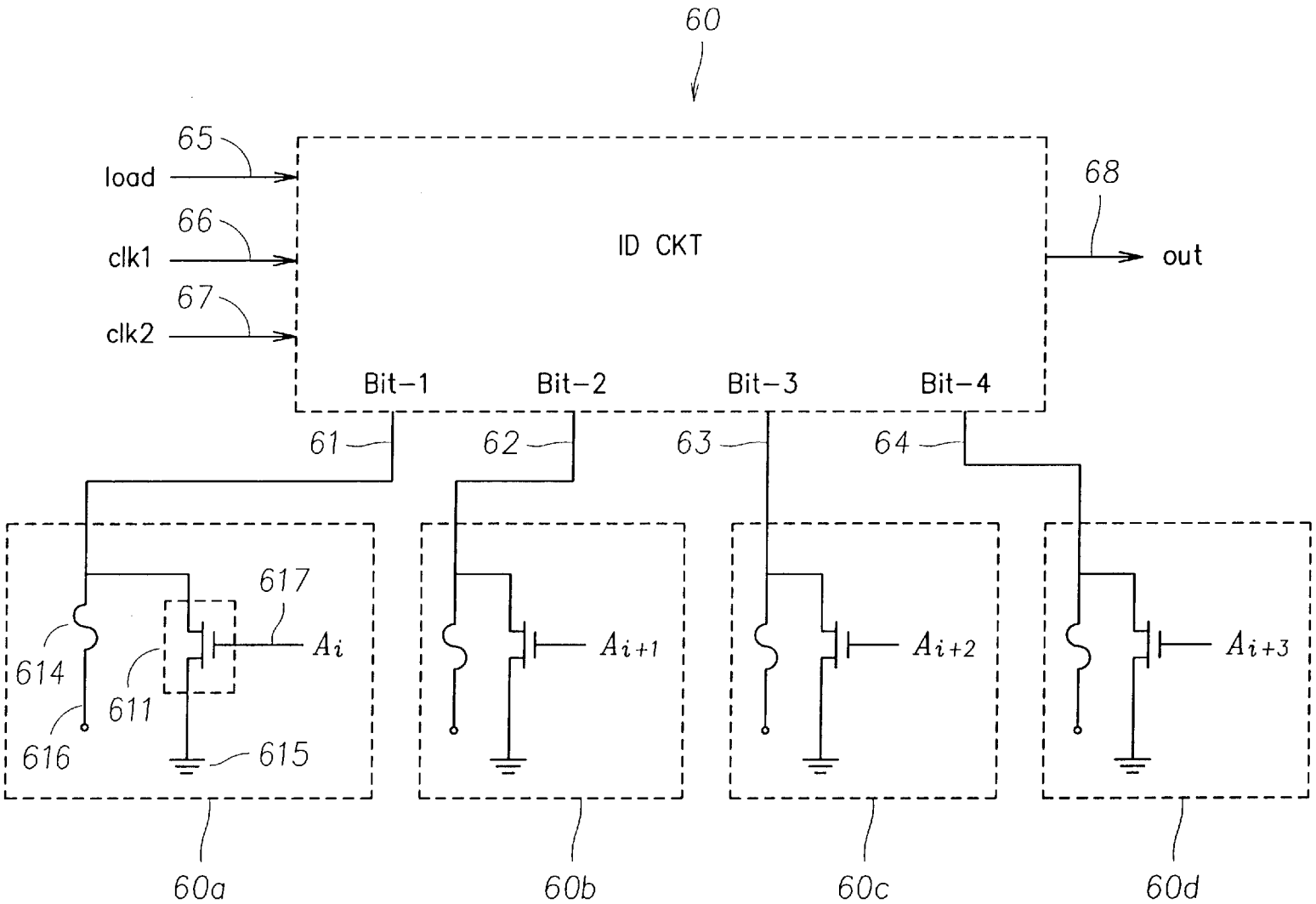
FIG. 8 is an identification circuit diagram of a parallel in, serial out, four-bit shift register in accordance with a third preferred embodiment of the present invention.

FIG. 8 illustrates an identification circuit diagram of a parallel in, serial out, four-bit shift register 60 in accordance with a third preferred embodiment of the present invention. The four-bit shift register 60 is primarily formed of serial connection of a first, a second, a third and a fourth one-bit shift register fuse circuits 60*a*, 60*b*, 60*c*, 60*d*.

Taking the first one-bit shift register fuse circuit 60*a* as an example, each programming route furnishes a one-bit identification code. A transistor 611 is electrically connected with a fuse 614. The electrical connection between the two is an output line 61 of the one-bit identification code. The other end of the transistor 611 is electrically connected to ground 615. The other end of the fuse 614 is electrically connected to a power source 616. The gate of the transistor 611 is electrically connected to an address line ($A_i$) 617. The program encoded to the first one-bit shift register fuse circuit 50*a* can only be one of the following two conditions:

Condition (1): When an appropriate voltage is applied to the power source 616 and while the address line 617 turns on the transistor 611, a programming route starts at the power source 616, going through the fuse 614 and the transistor 611, and ends at the ground 615. The high voltage is sufficient to burn the fuse 614. As such, a low level signal equivalent to 0 may be detected at the output line 61, as described hereinafter, for completing the encoding of the first one-bit shift register fuse circuit 60*a* and furnishing a one-bit identification code of '0'. As a logic high voltage is applied to the power source 616 and a low voltage is applied to the address line 617 to turn off the transistor 611, the burned fuse 614 would prevent the logic high voltage at the power source 616 from being read at the output line 61. Instead, a low level signal equivalent to 0 is the first bit read by the first one-bit shift register fuse circuit 50*a*.

Condition (2): By turning off the transistor 611 via the address line 617 that is connected to a low voltage such that the voltage applied to the power source 616 cannot reach the fuse 614, the integrity and conductivity of the fuse 614 is preserved. As such, a high level signal equivalent to 1 may be detected at the output line 61, as described hereinafter, for completing the encoding of the first one-bit shift register fuse circuit 60*a* and furnishing a one-bit identification code of '1'. As a logic high voltage is applied to the power source 616 and a low voltage is applied to the address line 617 to turn off the transistor 611, the logic high voltage at the power source 616 will pass through the fuse 614 and then transmitted to the first bit of the four-bit shift register 60 via the output line 61, such that the first bit of the four-bit shift register 60 is a high level signal equivalent to 1.

The same principle may be applied to the second, third and fourth one-bit shift register fuse circuits 60*b*, 60*c*, 60*d* based on condition (1) or (2) to complete the encoding of the second, third and fourth one-bit shift register fuse circuits 60*b*, 60*c*, 60*d* and to furnish a one-bit identification code of '0' or '1', respectively.

After completion of the encoding process, the first, second, third and fourth one-bit shift register fuse circuits 60*a*, 60*b*, 60*c*, 60*d* as shown in FIG. 8 are each capable of furnishing a one-bit identification code of 0 or 1. When load 65, clock one 66 and clock two 67 are activated in order, the four-bit shift register 60 in accordance with the third embodiment of the present invention outputs the furnished binary codes of the one-bit shift register fuse circuits 60*d*60*c*, 60*b* and 60*a* in sequence, at the output line 68. As such, the printer is capable of identifying the model number, color/gray-scale setting, and resolution of cartridge, and to detect whether the lifespan of the cartridge has elapsed based on the corresponding properties of the binary codes. By encoding binary codes prior to leaving the factory, the present invention provides identification of cartridge (model number, color/gray-scale setting, and resolution, etc.). By encoding binary codes after leaving the factory, the present invention provides detection of the current status of the cartridge (whether the lifespan of the cartridge has elapsed, etc.).

Fourth Preferred Embodiment

Figure 9:
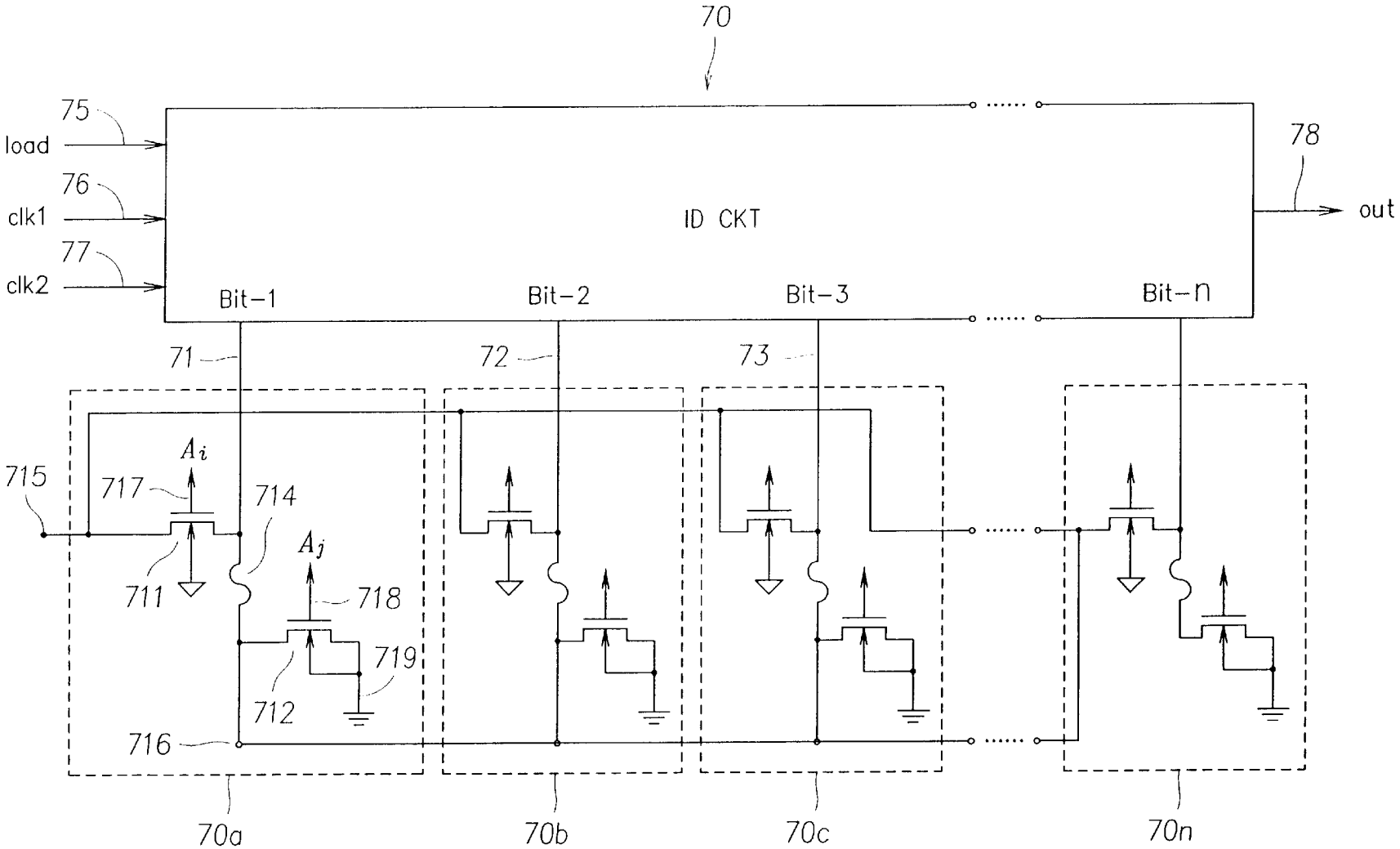
FIG. 9 is an identification circuit diagram of a parallel in, serial out, n-bit shift register in accordance with a fourth preferred embodiment of the present invention.

FIG. 9 is an identification circuit diagram of a parallel in, serial out, n-bit shift register 70 in accordance with a fourth preferred embodiment of the present invention. The n-bit shift register 70 is primarily formed of serial connection of a first, a second, a third, to an $n^{th}$ one-bit shift register fuse circuits 70*a*, 70*b*, 70*c*, to 70*n*.

Taking the first one-bit shift register fuse circuit 70*a* as an example, each programming route furnishes a one-bit identification code. A first transistor 711 is in serial connection with a fuse 714. The electrical connection between the two is an output line 71 of the one-bit identification code. The other ends of the first transistor 711 and fuse 714 are electrically connected to a first power source 715 and a second power source 716, respectively. A second transistor 712 is provided between the second power source 716 and a ground 719. The gates of the first transistor 711 and second transistor 712 are electrically connected to a first address line ($A_i$) 717 and a second address line ($A_j$) 718, respectively. The first power source 715 has the option of being connected either to a voltage source for accessing voltage or to an address line. The program encoded to the first one-bit shift register fuse circuit 70*a* can only be one of the following two conditions:

Condition (1): When an appropriate voltage is applied to the first power source 715 and while the first address line ($A_i$) 717 and second address line ($A_j$) 718 turn on the first transistor 711 and second transistor 712, respectively, a programming route starts at the first power source 715, going through the first transistor 711, the fuse 714, and the second transistor 712, and ends at the ground 719.

The appropriate voltage is sufficient to burn the fuse 714. As such, a low level signal equivalent to 0 may be detected at the output line 71, as described hereinafter, for completing the encoding of the first one-bit shift register fuse circuit 70*a* and furnishing a one-bit identification code of '0'. As a logic high voltage is applied to the second power source 716 and a low voltage is applied to the first address line 717 and second address line 718 to turn off the transistors 711 and 712, the burned fuse 714 would prevent the logic high voltage at the second power source 716 from being read at the output line 71. Instead, a low level signal equivalent to 0 is the first bit read by the first one-bit shift register fuse circuit 70*a*.

Condition (2): By turning off the first transistor 711 and the second transistor 712 via the first address line ($A_i$) 717 and the second address line ($A_j$) 718 that are connected to a low voltage, respectively, such that the voltage applied to the first power source 715 cannot reach the fuse 714, the integrity and conductivity of the fuse 714 is preserved. As such, a high level signal equivalent to 1 may be detected at the output line 71, as described hereinafter, for completing the encoding of the first one-bit shift register fuse circuit 70*a* and furnishing a one-bit identification code of '1'. As a logic high voltage is applied to the second power source 716 and a low voltage is applied to the first address line 717 and second address line 718 to turn off the first transistor 711 and second transistor 712, respectively, the logic high voltage at the second power source 716 will pass through the fuse 714 and transmitted to the first bit of the n-bit shift register 70 via the output line 71, such that the first bit of the n-bit shift register 70 is a high level signal equivalent to 1.

The same principle may be applied to the second, third to $n^{th}$ one-bit shift register fuse circuits 70*b*, 70*c* to 70*n* based on condition (1) or (2) to complete the encoding of the second, third to $n^{th}$ one-bit shift register fuse circuits 70*b*, 70*c* to 70*n* and to furnish a one-bit identification code of '0' or '1', respectively.

After completion of the encoding process, the first, second, third to $n^{th}$one-bit shift register fuse circuits 70*a*, 70*b*, 70*c* to 70*n* as shown in FIG. 9 are each capable of furnishing a one-bit identification code of 0 or 1. When load 75, clock one 76 and clock two 77 are activated in order, the n-bit shift register 70 in accordance with the fourth embodiment of the present invention outputs the furnished binary codes of the one-bit shift register fuse circuits 70*n* to 70*b* and 70*a* in sequence, at the output line 78. As such, the printer is capable of identifying the model number, color/gray-scale setting, and resolution of cartridge, and to detect whether the lifespan of the cartridge has elapsed based on the corresponding properties of the binary codes. By encoding binary codes prior to leaving the factory, the present invention provides identification of cartridge (model number, color/gray-scale setting, and resolution, etc.). By encoding binary codes after leaving the factory, the present invention provides detection of the current status of the cartridge (whether the lifespan of the cartridge has elapsed, etc.).

One advantage of this preferred embodiment is that n address lines ($A_1$–$A_n$) are used to encode $n\times(n-1)/2$ fuses. For example, only five address lines (A1, A2, A3, A4, A5 ) are needed to encode 10 fuses, exemplified as follows:

| Fuse | 1 | 2 | 3 | 4 | 5 | 6 | 7 | 8 | 9 | 10 |
|---|---|---|---|---|---|---|---|---|---|---|
| First address line ($A_1$) | A1 | A1 | A1 | A1 | A2 | A2 | A2 | A3 | A3 | A4 |
| Second address line ($A_2$) | A2 | A3 | A4 | A5 | A3 | A4 | A5 | A4 | A5 | A5 |

Figure 1:
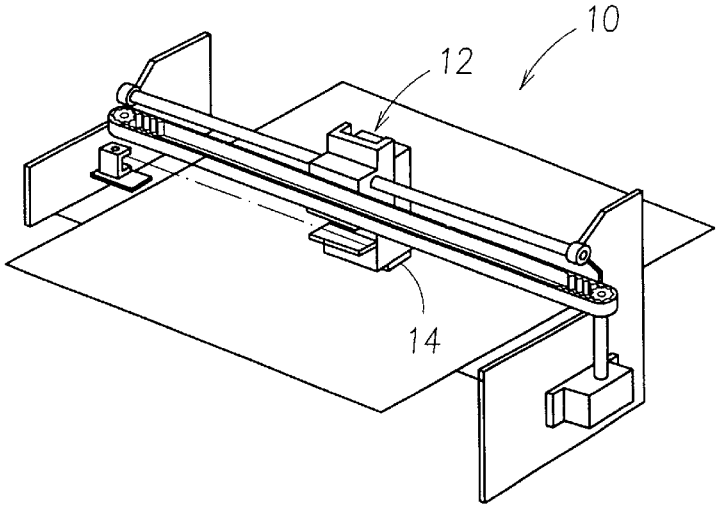
FIG. 1 (PRIOR ART)
FIG. 1 is a schematic view of a conventional inkjet printer.
Figure 2:
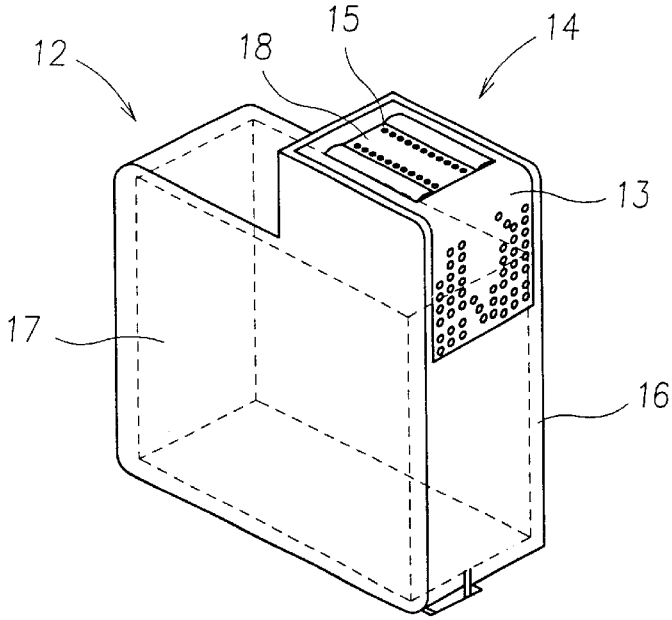
FIG. 2 (PRIOR ART)
FIG. 2 is a schematic view showing a cartridge used in FIG. 2.
Figure 3:
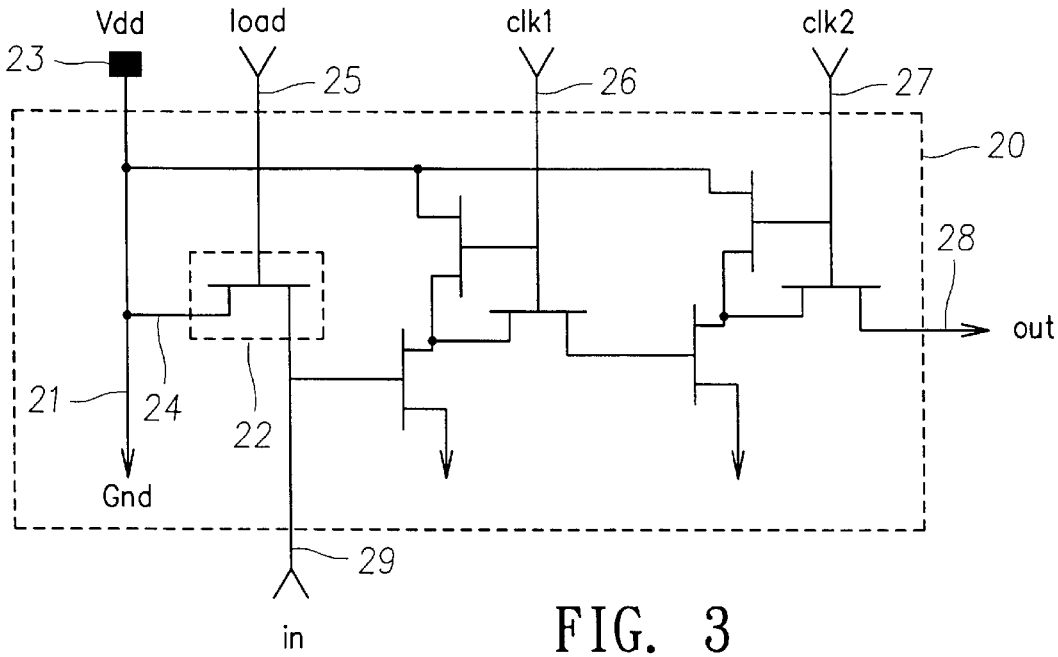
FIG. 3 (PRIOR ART)
FIG. 3 is the register circuit diagram for the one-bit shift register disclosed in U.S. Pat. No. 5,940,095.
Figure 4:
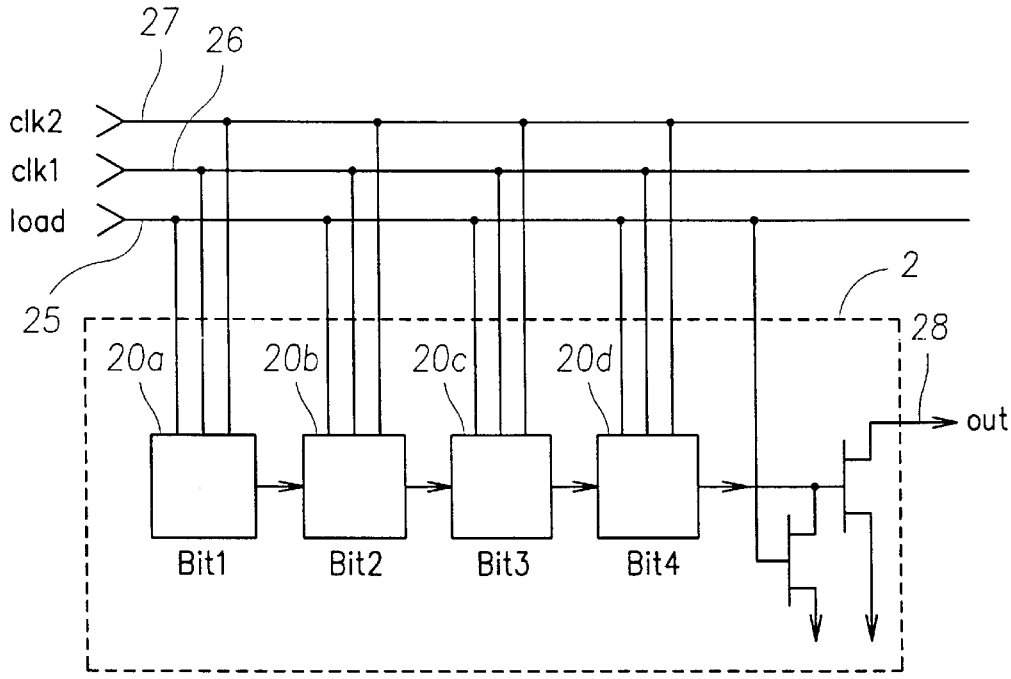
FIG. 4 (PRIOR ART)
FIG. 4 is the circuit diagram for the parallel in, serial out identification, four-bit shift register disclosed in U.S. Pat. No. 5,940,095.

The parallel in, serial out shift registers 40, 50, 60 and 70 in accordance with the present invention as described above, may be integrated into the chip 18 of the printhead 14 shown in FIG. 2. Shift registers consisting of different numbers of bits may also replace the four-bit shift registers 40, 50, and 60. The identification purpose of the identification circuit is not limited to the identification of the model number, serial number, color or gray-scale setting, and resolution of the cartridge; neither is the identification purpose of the identification circuit limited to the detection of whether the lifespan of the cartridge has elapsed.

In summary, the conventional U.S. Pat. No. 5,940,096 can only achieve the identification purpose by encoding the cartridge prior to leaving the factory. The present invention, however, allows encoding of the cartridge prior to leaving the factory, or subsequent to leaving the factory and usage to a certain state for achieving the identification and detection purposes. Further, the conventional U.S. Pat. No. 5,940,095 digitally encodes a default logic binary code (0 or 1) into a one-bit shift register 20 as being mask programmed during fabrication, while the present invention adopts fuses to establish the default logic binary code. Hence, the technical measures as adopted by and the effects as achieved by the present invention are distinguishably different from those disclosed in the conventional U.S. Pat. No. 5,940,095.

The above embodiments are intended for describing the present invention without limiting the scope that the present invention may be applied. Modifications made in accordance with the disclosures of the present invention without departing from the spirits of the present invention are covered by the equivalents of the present invention.

What is claimed is:

1. An inkjet printhead identification circuit, used in a printhead of a cartridge for identifying general information and detecting current status of the cartridge, comprising:

a power source, a ground, an output line, a first address line, and a second address line;

a first transistor and a first fuse in parallel connection, provided between the ground and the output line, the first transistor having a gate that is electrically connected to the first address line; and a second transistor and a second fuse in parallel connection, provided between the power source and the output line, the second transistor having a gate that is electrically connected to the second address line;

wherein, when the first address line turns on the first transistor and the second address line turns off the second transistor, an appropriate voltage applied to the power source burns the second fuse; and when the second address line turns on the second transistor and the first address line turns off the first transistor, an appropriate voltage applied to the power source burns the first fuse.

2. The inkjet printhead identification circuit of claim 1, wherein a plurality of identification circuits form a shift register.

3. The inkjet printhead identification circuit of claim 1, wherein a plurality of identification circuits form a logical circuit.

4. The inkjet printhead identification circuit of claim 1, wherein the general information is at least one of model number, serial number, color or gray-scale setting, and best printing quality.

5. The inkjet printhead identification circuit of claim 1, wherein the current status of the cartridge is to ascertain a ink volume in the cartridge in lower than a preset value.

6. An inkjet printing apparatus for furnishing identification information of a printhead to an inkjet printer, comprising:

a control circuit, for generating control signals that control operation of the inkjet printer;

an inkjet printhead performing printing operation based on the control signals generated by the control circuit;

an identification circuit, used in a printhead of a cartridge for identifying general information and detecting current status of the cartridge, comprising:

a power source, a ground, an output line, a first address line, and a second address line;

a first transistor and a first fuse connected in parallel, provided between the ground and the output line, the first transistor having a gate that is electrically connected to the first address line; and a second transistor and a second fuse in parallel connection, provided between the power source and the output line, the second transistor having a gate that is electrically connected to the second address line;

wherein, when the control circuit generates control signals commanding the first address line to turn on the first transistor and the second address line to turn off the second transistor, an appropriate voltage applied to the power source bums the second fuse; and when the control circuit generates control signals commanding the second address to turn on the second transistor and the first address line to turn off the first transistor, an appropriate voltage applied to the power source burns the first fuse.

7. An inkjet printhead identification method for identifying general information of a cartridge and detecting current status of the cartridge, comprising the steps of:

a. providing an identification circuit to a printhead of a cartridge, the identification circuit comprises:

a power source, a ground, an output line, a first address line, and a second address line;

a first transistor and a first fuse in parallel connection, provided between the ground and the output line, the first transistor having a gate that is electrically connected to the first address line; and a second transistor and a second fuse in parallel connection, provided between the power source and the output line, the second transistor having a gate that is electrically connected to the second address line;

b. burning the second fuse by an appropriate voltage applied to the power source when the first address line turns on the first transistor and the second address line turns off the second transistor; and c. burning the first fuse by an appropriate voltage applied to the power source when the control circuit generates control signals commanding the second address to turn on the second transistor and the first address line to turn off the first transistor.

* * * * *